US010947029B2

(12) United States Patent
Hokanson

(10) Patent No.: US 10,947,029 B2
(45) Date of Patent: Mar. 16, 2021

(54) FLEXIBLE SHEET DISPENSER

(71) Applicant: Kimberly-Clark Worldwide, Inc., Neenah, WI (US)

(72) Inventor: Brandon Mark Hokanson, Sheboygan Falls, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/605,340

(22) PCT Filed: Aug. 29, 2017

(86) PCT No.: PCT/US2017/049009

§ 371 (c)(1),
(2) Date: Oct. 15, 2019

(87) PCT Pub. No.: WO2019/045683

PCT Pub. Date: Mar. 7, 2019

(65) Prior Publication Data

US 2020/0331688 A1 Oct. 22, 2020

(51) Int. Cl.

| | |
|---|---|
| ***B65D 83/08*** | (2006.01) |
| ***A47K 10/42*** | (2006.01) |
| ***B65D 75/54*** | (2006.01) |

(52) U.S. Cl.

CPC ..... *B65D 83/0811* (2013.01); *A47K 10/42* (2013.01); *B65D 75/54* (2013.01);
(Continued)

(58) Field of Classification Search

CPC ..... A47K 10/42; A47K 10/421; B65D 5/54; B65D 5/542; B65D 75/54; B65D 75/58; B65D 75/5877; B65D 83/08; B65D 83/0805; B65D 83/0811; B65D 83/0847; B65D 2575/367; B65D 2575/54; B65D 2583/082; B65H 1/00
(Continued)

(56) References Cited

U.S. PATENT DOCUMENTS

| | | | |
|---|---|---|---|
| 3,606,082 | A | 9/1971 | Kuchenbecker |
| 4,570,820 | A | 2/1986 | Murphy |

(Continued)

FOREIGN PATENT DOCUMENTS

| | | | |
|---|---|---|---|
| GB | 1280218 | A | 7/1972 |
| JP | 2009107660 | A | 5/2009 |

*Primary Examiner* — Bryon P Gehman
(74) *Attorney, Agent, or Firm* — Kimberly-Clark Worldwide, Inc.

(57) ABSTRACT

Disclosed is a dispenser useful for storing and dispensing sheet material comprising a flexible outer wrapper, which may be formed from a single piece of plastic, defining an interior space for receiving the sheet material to be stored and dispensed. The outer wrapper has a top surface and a first opening disposed thereon. The dispenser further comprises a dispensing panel disposed between the stack of sheet material and the outer wrapper. The dispensing panel may be formed from a semi-rigid material, such as paperboard having a bending stiffness greater than about 200 Taber Stiffness Units so as to provide the dispenser with some structural integrity and facilitate dispensing of the sheet material.

18 Claims, 9 Drawing Sheets

(52) U.S. Cl.
CPC .... *B65D 2575/367* (2013.01); *B65D 2575/54* (2013.01); *B65D 2583/082* (2013.01)

(58) Field of Classification Search
USPC ..... 206/233, 494
See application file for complete search history.

(56) References Cited

U.S. PATENT DOCUMENTS

| | | | | |
|---|---|---|---|---|
| 5,316,177 | A | 5/1994 | Boldt | |
| 5,729,955 | A | 3/1998 | Yamada | |
| 6,296,144 | B1 | 10/2001 | Tanaka et al. | |
| 6,672,475 | B1 | 1/2004 | Ho et al. | |
| 9,327,892 | B2 * | 5/2016 | Rubo | B65D 75/5838 |
| 9,586,743 | B2 | 3/2017 | Carlson et al. | |
| 10,442,594 | B2 * | 10/2019 | Hallam | B65D 83/0805 |
| 2005/0011906 | A1 * | 1/2005 | Buck | B65D 75/5877 221/64 |
| 2006/0138159 | A1 | 6/2006 | Altuve et al. | |
| 2007/0034534 | A1 | 2/2007 | VanBuren | |
| 2011/0147401 | A1 | 6/2011 | Rubo et al. | |
| 2014/0190859 | A1 | 7/2014 | Yamada | |
| 2019/0291942 | A1 * | 9/2019 | Lange | B65D 83/0894 |
| 2020/0071061 | A1 * | 3/2020 | Ellonen | B65B 25/141 |

* cited by examiner

FLEXIBLE SHEET DISPENSER

BACKGROUND OF THE INVENTION

The present invention relates to a dispenser for holding and dispensing dry sheet material and in particular tissue products such as absorbing, wiping, and cleaning tissues, facial tissues, and the like. Prior art dry sheet material dispensers are commonly constructed of rigid or semi-rigid materials such as paperboard or plastic which cannot be compressed without damaging the dispenser. Further, the dispensers generally rely upon the sheet material having a particular fold pattern or specially designed dispensing orifice to facilitate dispensing of the sheet material. For example, certain prior art tissue dispensers are provided with a dispensing window having a narrow slit through which the tissue product is dispensed. The dispensing window slit retains the sheet, preventing the sheet from falling back into the container, and aids in dispensing.

The inability to compress the prior art cartons without damaging the dispensers increases the cost of transportation and shipping of the cartons. Further, the need for specific folding patterns and/or dispensing orifice designs increases the cost and complexity of such dispensers. Therefore, what is needed is a compressible dispenser having a simple dispensing orifice.

SUMMARY

It has now been discovered that a compressible and flexible sheet material dispenser may be formed from a flexible material, such as a polymeric film having a bending stiffness less than about 20.0 Taber Stiffness Units, such as from 2.0 to about 20.0 Taber Stiffness Units, and a semi-rigid dispensing panel, such as a paperboard sheet having a bending stiffness greater than about 100 Taber Stiffness Units, such as from about 200 to about 400 Taber Stiffness Units. To improve packaging, compression, storage and dispensing the semi-rigid dispensing panel is generally disposed between the uppermost sheet in the stack of stored sheet material and the wall of the dispenser through which the sheet is dispensed. The semi-rigid dispensing panel provides the flexible dispenser with integrity and facilitates the formation of substantially planar top and side panels, which enhances the overall aesthetic appearance of the dispenser and improves the visibility of indicia printed on the dispenser walls. The semi-rigid dispensing panel also improves dispensing of the sheet material and reduces tearing of the flexible packaging material by reducing or eliminating contact between the dispenser wall and sheet material during dispensing. While providing the dispenser with a degree of integrity and improving dispensing, the semi-rigid dispensing panel does not impede compression of the dispenser.

Accordingly, in one embodiment the present invention provides a sheet material dispenser comprising a top wall, a bottom wall, a pair of opposed side walls extending between the top and bottom walls, the top, bottom and side walls defining an interior space, a first dispensing opening disposed on the top wall, the first opening having a major axis and a minor axis perpendicular thereto, the major axis defining the dispensing opening length and the minor axis defining the dispensing opening width, a stack of sheets disposed within the interior space and a semi-rigid dispensing panel disposed between the uppermost sheet in the stack and the top wall, the semi-rigid dispensing panel having a second dispensing opening disposed thereon.

In another embodiment the present invention provides a flexible sheet material dispenser having a longitudinal and a transverse axis comprising a flexible polymeric sheet material folded and sealed to provide first and second transverse end seals and a longitudinal fin seal and defining an interior space, a stack of folded sheet material disposed within the interior space, the polymeric sheet material having a removable portion defining a first dispensing opening, and a paperboard sheet disposed between the stack of folded sheet material and the polymeric sheet material, the paperboard sheet having a removable portion defining a second dispensing opening and wherein the first and second dispensing openings at least partially overlap one another.

In still other embodiments the present invention provides a dispenser for storing and dispensing a stack of dry tissue products comprising a flexible outer wrapper defining a cavity, the outer wrapper having first and second sealed ends, a top wall and a bottom wall, the top wall having a length and a width and a plurality of perforations defining a first dispensing opening having a length and a width, a stack of folded dry tissue products disposed within the cavity, the stack having a length and a width and an uppermost tissue product, a semi-rigid dispensing panel having a bending stiffness from about 200 to about 400 Taber Stiffness Units disposed between the uppermost tissue product and the top wall of the flexible outer wrapper, the semi-rigid dispensing panel having a length and a width and a removable surfboard defining a second dispensing opening having a length and a width; wherein the length of the first dispensing opening is at least about 80 percent of the length of the top wall.

In yet other embodiments the present invention provides a dispenser for storing and dispensing a stack of dry tissue products comprising a flexible outer wrapper defining a cavity, the outer wrapper having first and second sealed ends, a top wall and a bottom wall, the top wall having a length and a width and a plurality of perforations defining a first dispensing opening having a length and a width, a stack of dry tissue products disposed within the cavity, the stack having a length and a width and an uppermost tissue product, a semi-rigid dispensing panel disposed between the uppermost tissue product and the top wall of the flexible outer wrapper, the semi-rigid dispensing panel having a length and a width and a removable surfboard defining a second dispensing opening having a length and a width, wherein the length of the first dispensing opening is at least about 80 percent of the length of the top wall.

In other embodiments the present invention provides a dispenser for storing and dispensing a stack of dry tissue products comprising a flexible outer wrapper defining a cavity, the outer wrapper having first and second sealed ends, a top wall and a bottom wall, the top wall having a first dispensing opening disposed thereon, the first dispensing opening having a length and a width; a stack of dry tissue products disposed within the cavity, the stack having a length and a width and an uppermost tissue product; a paperboard sheet disposed between the uppermost tissue product and the top wall of the flexible outer wrapper, the paperboard sheet having a length and a width and a plurality of perforations defining a removable surfboard disposed thereon, the removable surfboard forming a second dispensing opening having a length and a width; wherein the length of the second dispensing opening is from about 80 to about 95 percent of the length of the top wall.

In still other embodiments the present invention provides a dispenser for storing and dispensing a stack of sheet material comprising a flexible outer wrapper defining a cavity, the outer wrapper having first and second sealed ends, a top wall and a bottom wall, the top wall having a length and a width and a plurality of perforations defining a first dispensing opening having a length and a width; a stack of sheet material disposed within the cavity, the stack having a length and a width and an uppermost sheet; a dispensing panel having a bending stiffness from about 100 to about 400 Taber Stiffness Units disposed between the uppermost sheet and the top wall of the flexible outer wrapper, the dispensing panel having a length and a width and a second dispensing opening disposed thereon, the second dispensing opening having a length and a width and a breaker bar attached to the dispensing panel, wherein the length of the first dispensing opening is at least about 80 percent of the length of the top wall.

DEFINITIONS

Figure 1:
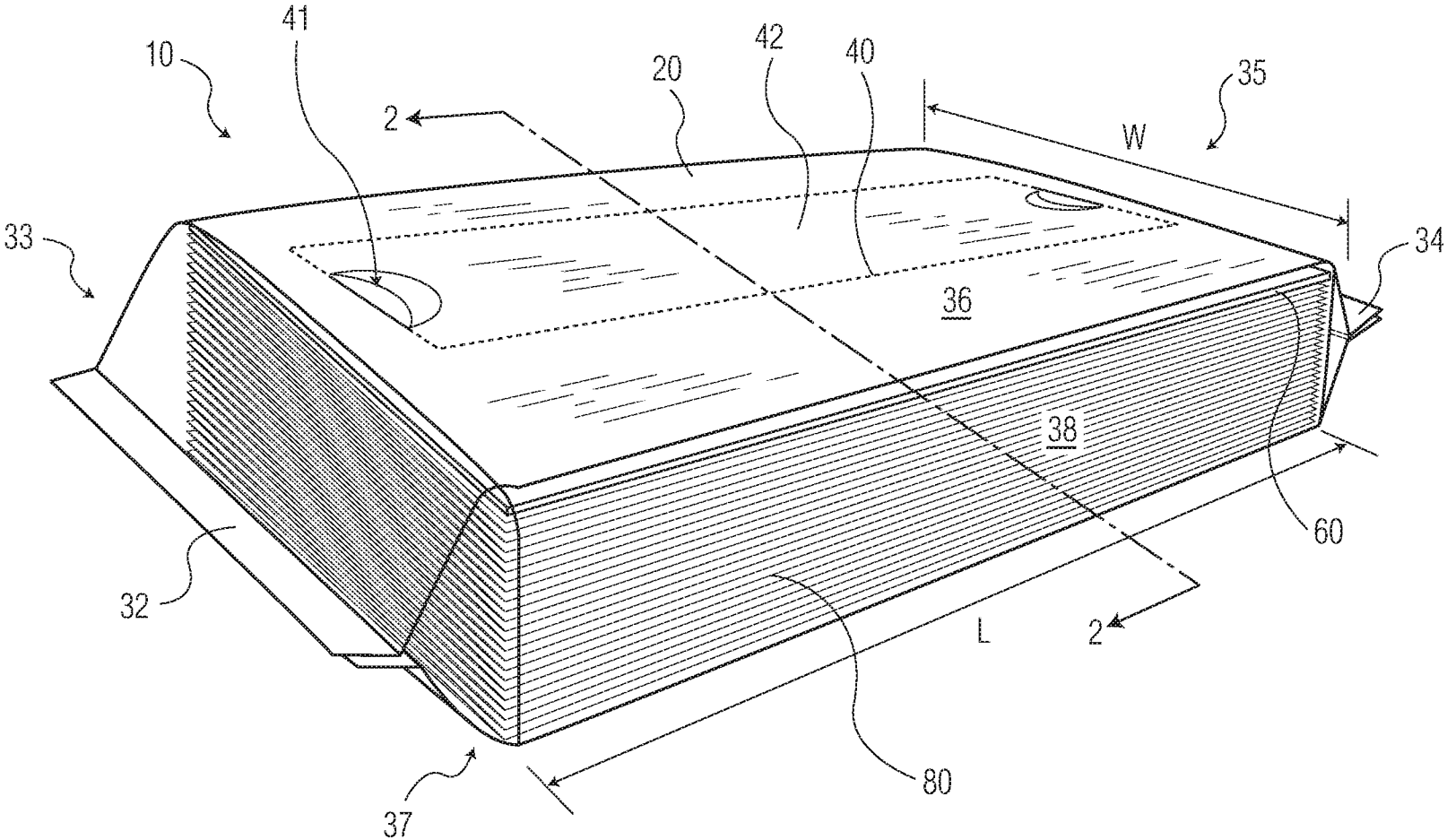
FIG. 1 is a perspective view of a dispenser according to one embodiment of the present invention.

As used herein, the term "basis weight" refers to the grammage of a sheet, roll, etc., of a fibrous structure, as determined by TAPPI test T410. The basis weight of a fibrous structure is essentially a measure of the density of that paperboard per unit area, herein reflected in units of lbs/3000 $ft^2$. The semi-rigid dispensing panel useful in the present invention may comprise a paperboard sheet having a basis weight in the range of from about 100 to about 300 lbs/3000 $ft^2$, such as from about 140 to about 200 lbs/3000 $ft^2$.

As used herein, the term "caliper" refers to the thickness of a sheet, web, etc., of a material, for example, a material comprising the semi-rigid dispensing. Caliper may have units of "mil(s)" referring to thousandths of an inch. In certain embodiments a semi-rigid dispensing panel useful in the present invention may comprise a paperboard sheet having a caliper in the range from about 10 to about 30 mils, such as from about 15 to about 20 mils.

As used herein, the term "bending stiffness" refers to flexural rigidity of a material used in the construction of the present dispenser, such as the film overwrap or a semi-rigid dispensing panel. Bending stiffness generally depends upon both the modulus of elasticity of and thickness of the material and is measured herein in terms of Taber Stiffness Units in the machine direction (MD).

As used herein, "Taber Stiffness Units" are defined as the bending moment of ⅕ of a gram applied to a 1.5" wide specimen of paperboard at a 5 centimeter test length, flexing it to an angle of 15°. A Taber Stiffness Unit is the equivalent of one gram centimeter. The method used herein for measuring Taber Stiffness is TAPPI T566 (Bending Resistance (Stiffness) of Paper). The semi-rigid dispensing panel useful in the present invention may comprise a paperboard sheet having a bending stiffness (measured in the MD) greater than about 200 Taber Stiffness Units, such as from about 200 to about 400 Taber Stiffness Units and more preferably from about 220 to about 300 Taber Stiffness Units.

As used herein, the term "attach" refers to elements being connected or united by adhering, bonding by any method suitable for the elements being attached together and their constituent materials. Elements may be attached "permanently," i.e., attached in such a way that one or both elements must be damaged in order to separate them. Alternatively, elements may be attached "releasably" or "non-permanently," i.e., attached in such a way that neither of the elements needs to be damaged in order to separate.

As used herein, the term "disposed" refers to an element being positioned in a particular place.

DETAILED DESCRIPTION

Generally the present invention provides a dispenser useful for storing and dispensing sheet material. In certain embodiments the dispenser comprises a flexible outer wrapper, which may be formed from a single piece of polymeric film, defining an interior space for receiving the sheet material to be stored and dispensed. The outer wrapper has a top surface and a first opening disposed thereon. In certain instances the first opening may be at least partially covered with a removable portion. Below the top surface, generally disposed between the top surface and the sheet material to be dispensed, is a dispensing panel having a length and a width. In certain preferred embodiments the dispensing panel length and width are approximately equal to the length and width of the top surface of the dispenser. The dispensing panel is preferably formed from a semi-rigid material, such as a material having a bending stiffness greater than about 200 Taber Stiffness Units, such as from about 200 to about 400 Taber Stiffness Units, so as to provide the dispenser with some structural integrity and facilitate dispensing of the sheet material. The dispensing panel is provided with a second opening, which may be covered with a removable portion. Together the first and second openings co-define a dispensing orifice through which sheet material may be withdrawn from the interior space and dispensed. In particularly preferred embodiments the first and second openings have a first and a second length, which are substantially equal and from about 80 to about 98 percent of the length of the dispensing panel.

The outer most portion of the dispenser generally comprises a flexible outer wrapper that has been folded and sealed to provide walls defining an interior space for receiving the sheet material to be stored and dispensed. The flexible outer wrapper may be formed partially or wholly of a flexible sheet material, such as a flexible polymeric sheet material, having a bending stiffness less than about 20.0 Taber Stiffness Units, such as from about 2.0 to about 20.0 Taber Stiffness Units and more preferably from about 4.0 to about 10.0 Taber Stiffness Units. Suitable polymeric materials may include polyethylene, polypropylene, polyethylene terephthalate, polyamide, polyester, polyvinylchloride and combinations thereof. The polymeric material(s) utilized in the flexible outer wrapper may have the form of a sheet and may include only a single layer or multiple layers in a laminated structure. Such a laminated structure may include more than one sheet of polymeric material and/or may include a layer or layers in other forms, such as a fibrous sheet, an aluminum foil or an adhesive layer. The film or laminate may contain fillers such as silica, alumina and/or calcium carbonate.

The material forming the flexible outer wrapper may be gas impervious or liquid impervious depending on the individual sheets dispensed. For instance, if the need to contain moisture or the need to exclude moisture exists, such as when wet wipes are stored in the dispenser, then a flexible sheet material which is impervious to liquid may be used to form the flexible outer wrapper as described above. In another instance, a flexible sheet material which is impervious to gas and liquid may be used to form the flexible outer wrapper when perfumes are contained in the lotion impregnating the wipes. If neither of these needs exits, the flexible sheet material may be water-permeable and gas-permeable.

The flexible outer wrapper may be folded and sealed to take any number of different shapes suitable for receiving sheet material to be stored and dispensed. The flexible outer wrapper may be a sheet material folded to provide a dispenser having a cylindrical, polygonal or parallelepipedal shape, for example.

Figure 2:
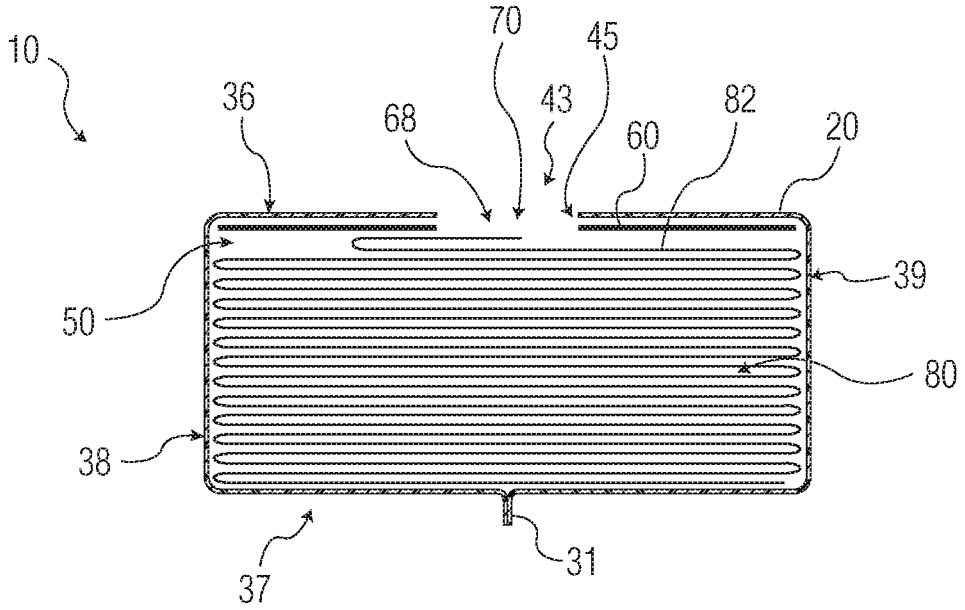
FIG. 2 is a cross-section view of the dispenser of FIG. 1 through the line 2-2.
Figure 3:
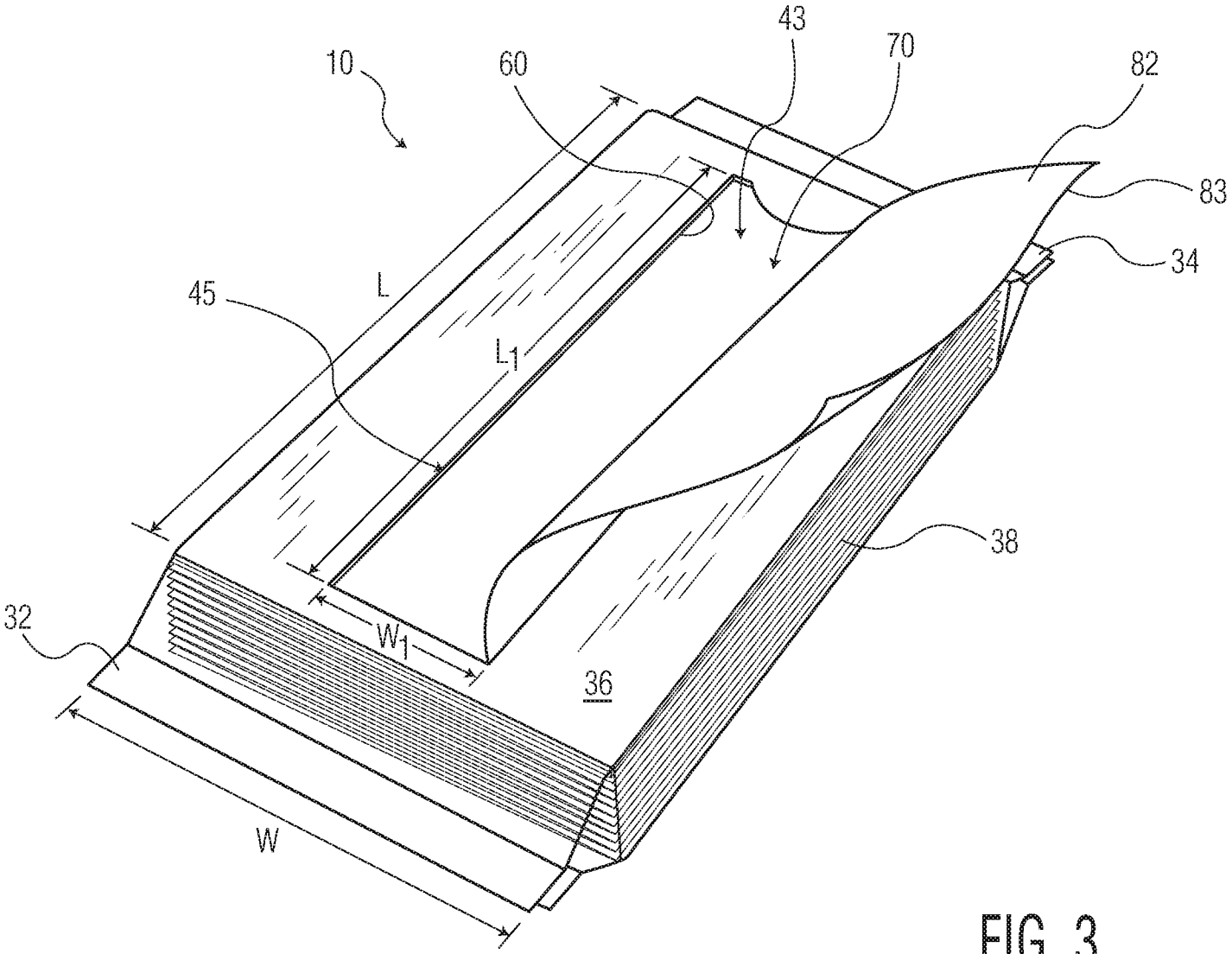
FIG. 3 is a perspective view of a dispenser according to another embodiment of the present invention.

With reference now to FIGS. 1-3 an exemplary embodiment of a dispenser 10 comprising a flexible outer wrapper 20 formed of a flexible polymeric sheet material is illustrated. The flexible outer wrapper 20 is folded and sealed so as to define a dispenser 10 having a top wall 36, an opposing bottom wall 37, opposing end walls 33 and 35, and opposing first and second sidewalls 38 and 39. The dispenser 10 forms a generally parallelepipedal configuration having a longitudinal direction having a length (L) and a transverse direction having a width (W). The opposing end walls 33 and 35 are closed by end seals 32 and 34, which are generally arranged in the transverse direction of the dispenser 10. The walls 33, 35, 36, 37, 38 and 39 define and enclose the interior space 50 of the flexible outer wrapper 20 which houses a stack of sheet material 80.

The sheet material stored and dispensed by the present dispenser preferably comprises a stack of tissue sheets and more preferably a stack of dry tissue sheets. In certain embodiments the sheets may be folded, for example, the stack may comprise a plurality of tissue sheets where the sheets are V-folded, Z-folded or C-folded and then the folded tissue sheets may be stacked one upon the other. In a particularly preferred embodiment, the sheets are interfolded with one another such that when the uppermost sheet in the stack is dispensed the next sheet, which is interfolded therewith, is partially dispensed from the dispenser. In other embodiments the stack of sheets may comprise a plurality of sheets connected to one another by a line of perforations or the like such that an individual sheet is separable from the plurality upon dispensing by breaking the line of perforations. As will be discussed in more detail below, in certain preferred embodiments the perforated stack of folded sheets may also comprise a notch to cooperate with certain features of the dispensing panel to improve dispensing.

Figure 4:
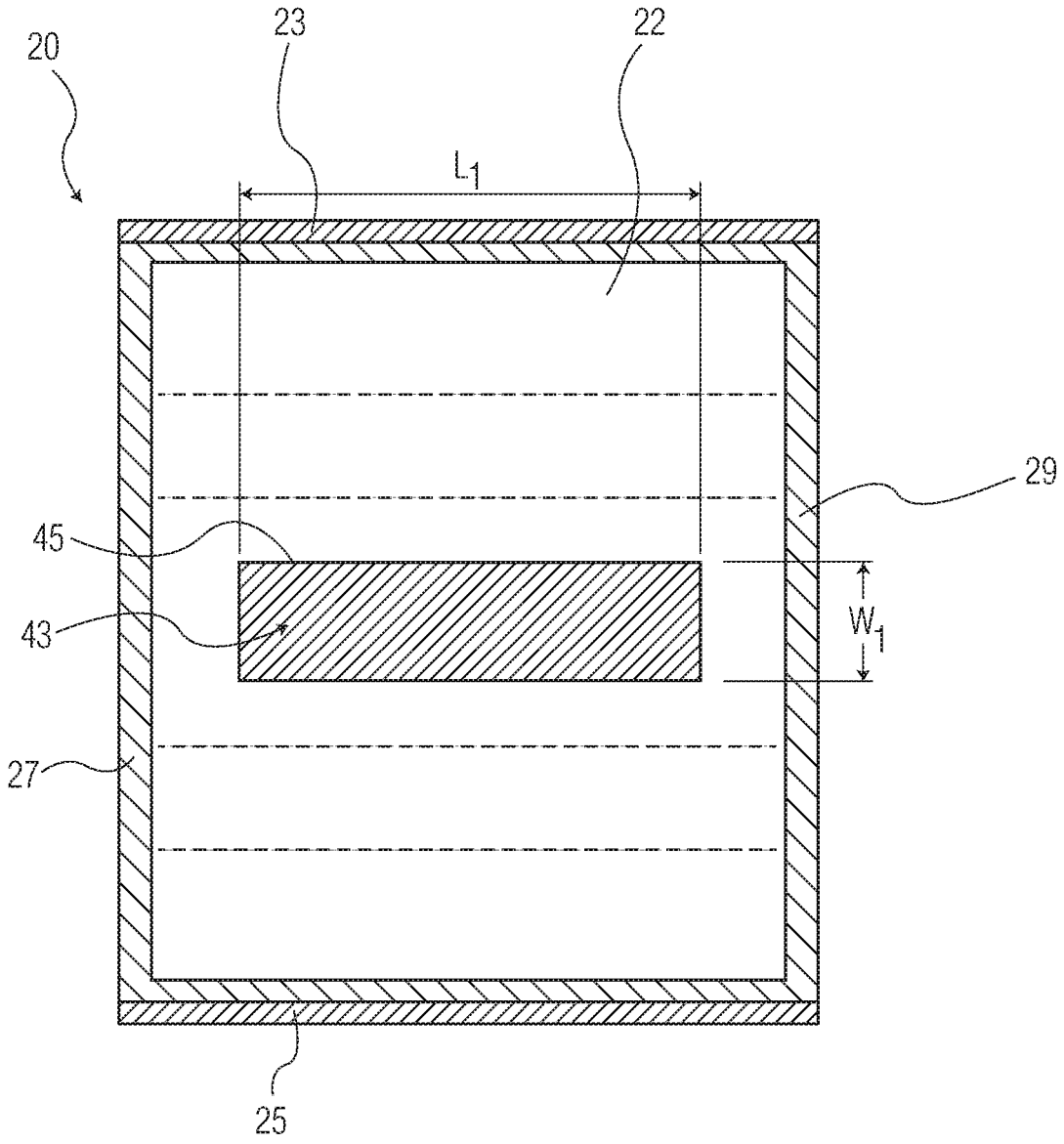
FIG. 4 is a top plan view of a film wrapper useful in the dispenser of the present invention.

With reference now to FIG. 4, the flexible outer wrapper 20 may be formed from a single rectangular sheet 22 of flexible sheet material. The sheet 22 is provided with an arrangement of fold lines (shown as dotted lines) to facilitate folding of the sheet 22. In order to assemble the outer wrapper 20, opposed lateral edges 23 and 25 are folded together and the edges are joined to form a longitudinal seal (also referred to as a fin seal and illustrated as seal 31 in FIG. 2). Joining may be carried out using techniques well known in the art, including heat and pressure to activate heat-sealable sheet material, or an adhesive that has been previously placed on mating faces of the lateral edges. The resulting elongated tube may be filled with stacks of sheet material and a dispensing panel. After the sheet material and dispensing panel have been placed in the elongated tube the folded over leading edge 27 may be sealed to form a first end seal (illustrated as 32 in FIG. 1) adjacent a first distal or outer end of the stack of sheet material. Next, the folded over trailing edge 29 may be sealed to form a second end seal (illustrated as 34 in FIG. 1) adjacent a second distal or outer end of the stack of sheet material.

As further illustrated in FIG. 4, the flexible outer wrapper 20 may be provided with at least one cut-out portion defining a first dispensing opening 43 having a peripheral edge 45. In other embodiments, which will be discussed in more detail below, the wrapper may be provided with a first dispensing opening that is at least partially covered by a removable portion. The removable portion may be attached to the wrapper by perforations or a line of weakness and defining at least a portion of the first dispensing opening. The first dispensing opening 43 generally has a shape delimited by a peripheral edge 45.

When the wrapper 20 is folded into a dispenser 10, such as that illustrated in FIG. 3, the first dispensing opening 43 is disposed on the top wall 36 and permits a user to access the leading edge 83 of the uppermost tissue sheet 82. While in the embodiment illustrated in FIGS. 1-3, the first dispensing opening 43 is disposed on the top wall 36, the invention is not so limited and the opening may be disposed on any surface of the outer wrapper.

The first dispensing opening may be fully formed during the manufacturing process or its border may be defined, but not cut out, by providing a line of weakness, perforation or scoring of the sheet material forming the flexible outer wrapper. For example, with reference to FIG. 1, the dispensing opening may be covered with a removable portion 42 attached to the wrapper 20 by a line of perforations 40 that define at least a portion of the first dispensing opening (illustrated in FIG. 2 as 43). The removable portion can be used to prevent foreign materials from entering the assembled dispenser and provides protection for the sheet material during loading and shipping. In the embodiment illustrated in FIG. 1, the removable portion 42 defines the first dispensing opening and is removed from the outer wrapper 20 by a user to form the first dispensing opening. The removable portion 42 may be provided with a tab 41 for easing grasping by a user when removing the portion 42 to form the first dispensing opening.

The first dispensing opening 43 may have any shape suitable for access into the interior space 50 of the dispenser 10. The exemplary first dispensing opening 43, as shown in FIGS. 2-4, has a relatively simple rectangular shape delimited by a peripheral edge 45. While the first dispensing opening is illustrate as having a relatively simple shape the invention is not so limited and the opening may have a circular, semi-circular or oval shape, or may have a relatively complex shape, such as a generally rectangular shape with rounded corners, or a shape with multiple protrusions, e.g., shape of clover leaf or peanut.

Regardless of the shape of the first dispensing opening, the first dispensing opening generally comprises a major axis and a minor axis perpendicular thereto, the major axis defining the dispensing opening length and the minor axis defining the dispensing opening width. For example, as shown in FIGS. 3 and 4, the first dispensing opening 43 has a length ($L_1$) and a width ($W_1$). Preferred first dispensing opening lengths ($L_1$) will be discussed further below, particularly in relation to the length of the sheet material to be dispensed, the length of the top wall (L) and the length (l) of the second dispensing opening formed in the dispensing panel.

In certain embodiments the flexible outer wrapper may include a releasable sealing member for sealing the first dispensing opening. By "releasable" as used herein, it is meant that the sealing member can be separated intentionally from the outer wrapper by the user without being damaged or without damaging the wrapper. At first opening, the sealing member is pulled away from the surface of the wrapper to expose the first dispensing opening and provide access to the sheets enclosed in the wrapper. The sealing member can then be re-adhered to the wrapper to reseal the dispensing opening.

As noted previously, the dispenser comprises a dispensing panel, which is generally disposed between the overwrap and the stack of sheet material and more preferably between the top wall bearing the first dispensing opening and the uppermost sheet in the stack of sheet material. The dispensing panel of the present disclosure is believed to aid in the dispensing of sheet material. For example, the dispensing panel may be provided with a second dispensing opening shaped to provide more uniform resistance against the outer edges of the uppermost sheet in the stack as it is pulled through the second dispensing opening during dispensing. In other instances the dispensing panel may add rigidity to the dispenser and may increase stability and compressive resistance to aid in the packing and shipping of dispensers.

The dispensing panel is generally formed from a semi-rigid sheet having a bending stiffness greater than the bending stiffness of the outer wrapper material. For example, the outer wrapper may be formed from a flexible sheet material having a bending stiffness from about 2.0 to about 20.0 Taber Stiffness Units, and more preferably from about 4.0 to about 10.0 Taber Stiffness Units and the dispensing panel may be formed from a material having a bending stiffness greater than about 100 Taber Stiffness Units, such as from about 100 to about 400 Taber Stiffness Units and more preferably from about 200 to about 300 Taber Stiffness Units. In particularly preferred embodiments the dispensing panel and the outer wrapper not only have a different bending stiffness, but are formed from different materials. For example, in one embodiment the dispensing panel is formed from paperboard and has a bending stiffness from about 200 to about 300 Taber Stiffness Units and the outer wrapper is formed from a sheet of polymeric film having a bending stiffness from about 4.0 to about 10.0 Taber Stiffness Units.

In certain embodiments the dispensing panel may be formed from paper, cardboard, paperboard, plastic, aluminum foil or combinations thereof. In particularly preferred embodiments the dispensing panel is formed from paper, cardboard, or paperboard. More preferably, the dispensing panel is formed from paperboard, optionally coated with one or more layers of plastic. For example, the dispensing panel may comprise a paper sheet, such as paperboard or cardboard, which has been subjected to converting such as calendering, laminations, or coating, such as coating with an aqueous barrier coating, a pigmented coating, or an extrusion coating.

The dispensing panel preferably has a stiffness sufficient to provide the dispenser with a degree of rigidity to facilitate dispensing of the dispenser contents and to resist compression and deformation of the dispenser during shipping. In certain preferred embodiments the dispensing panel has a bending stiffness greater than about 100 Taber Stiffness Units, such as from about 100 to about 400 Taber Stiffness Units, more preferably from about 200 to about 350 Taber Stiffness Units and still more preferably from about 250 to about 300 Taber Stiffness Units. In other embodiments the dispensing panel may comprise a paperboard sheet having a caliper from about 10 to about 30 mils and more preferably from about 15 to about 20 mils. In other embodiments the dispensing panel may comprise a paperboard sheet having a basis weight from about 100 to about 300 lbs/3000 $ft^2$, and more preferably from about 140 to about 200 lbs/3000 $ft^2$.

Figure 5:
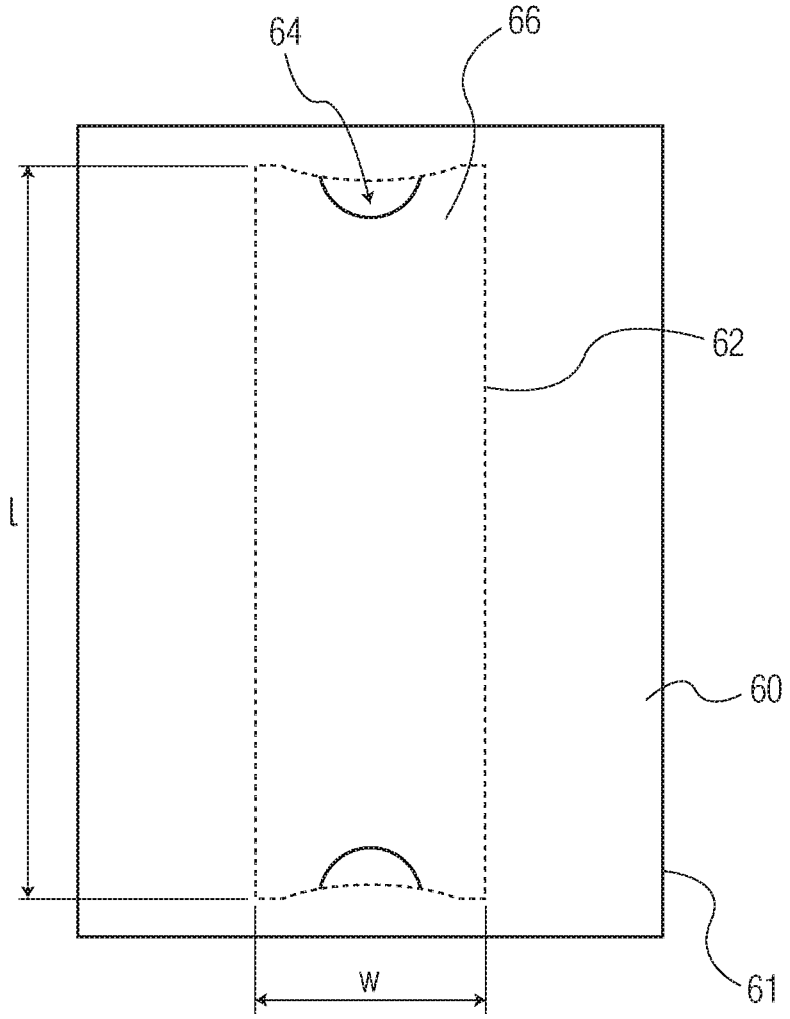
FIG. 5 is a top plan view of a dispensing panel useful in the dispenser of the present invention.

The dispensing panel may include an optional removable portion, commonly referred to in the art as a surfboard, attached to the panel by perforations or line of weakness and defining at least a portion of the second dispensing opening. For example, with reference to FIG. 5, disposed on the dispensing panel 60 is a surfboard 66 which is attached to the panel 60 by a line of perforations 62. In a particularly preferred embodiment the surfboard 66 may also comprise a finger tab 64 to facilitate removal. Removal of the surfboard generally results in formation of a second dispensing opening disposed on the dispensing panel through which a user may access the sheet material stored within the dispenser.

In certain embodiments, to further facilitate opening of the dispenser, the surfboard may be attached to a removable portion of the overwrap, such that when the removable portion of the overwrap is removed by a user the surfboard strip is also removed. The dispensing panel may be fixedly associated with the outer wrap. For example, the dispensing panel may be associated with the outer wrap by adhesive and/or mechanical attachment. In one embodiment, the dispensing panel may be fixedly attached to at least a portion of the second side of the top wall of the wrapper. For example, the dispensing panel may be attached to the second side of the top wall by an adhesive disposed between the dispensing panel and the second side.

The dispensing panel may comprise any shape and/or size suitable for providing resistance during dispensing. The dispensing panel may be formed from a unitary piece of semi-rigid material or may be formed from two or more pieces. In certain embodiments, such as that illustrated in FIGS. 3 and 5, the dispensing panel 60 is substantially rectangular and in a planar form. The outer perimeter 61 defines a dispensing panel 60 having a length and a width. In certain embodiments the length and a width are substantially equal to the length (L) and the width (W) of the top wall 36 of the dispenser 10. In other embodiments, the length and a width may be less than length (L) and the width (W) of the top wall 36. In particularly preferred embodiments, regardless of the dimensions of the dispensing panel it is generally preferred that the panel is planar and does not have sidewalls extending from its planar top surface. In such embodiments, it is generally preferred that the dispensing panel does not extend beyond the top wall such that there is no additional material disposed between the first and second sides 38, 39 of the dispenser.

Figure 8:
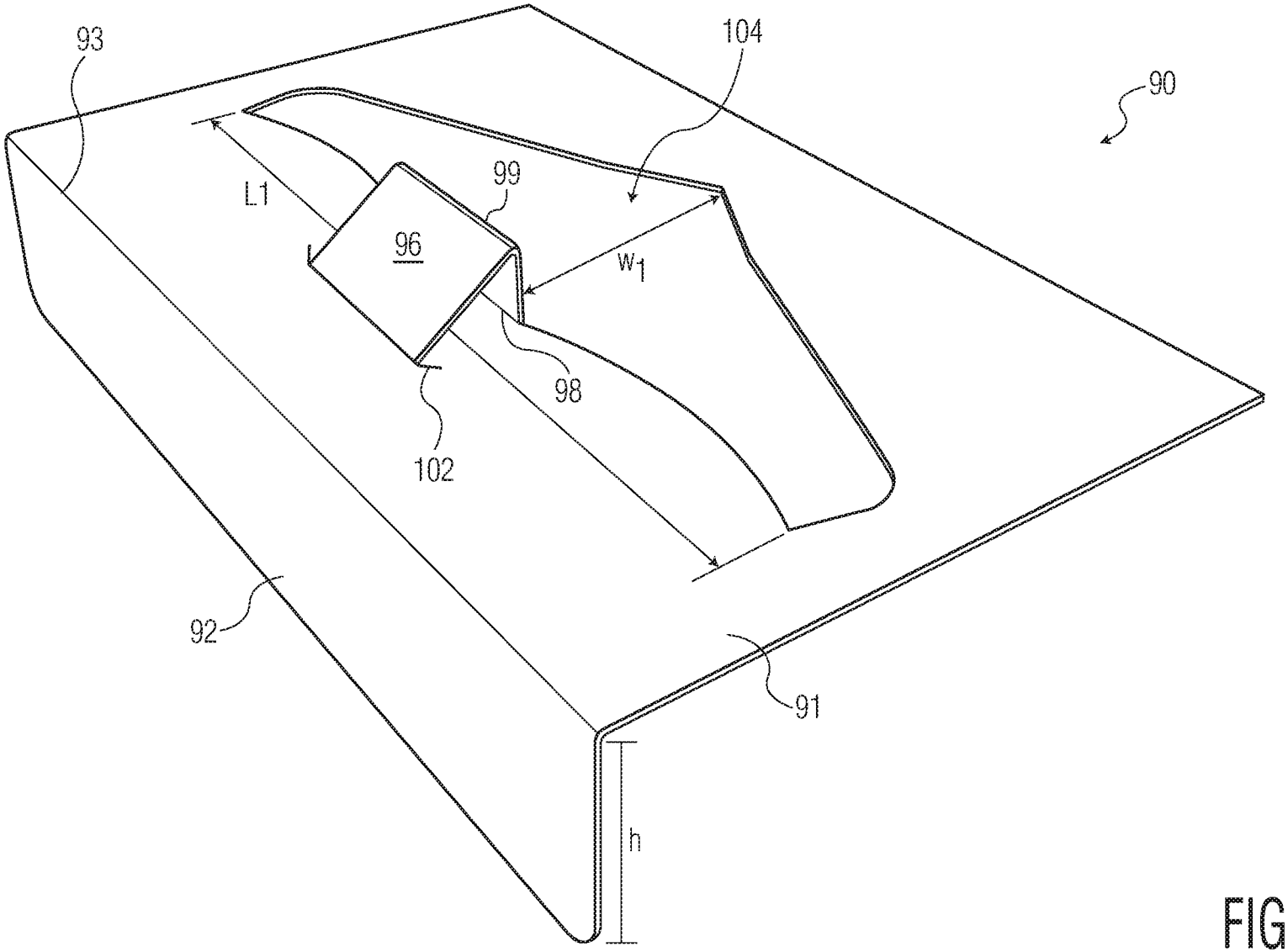
FIG. 8 is a perspective view of a dispensing panel useful in the dispenser of the present invention.

In other embodiments, such as that illustrated in FIG. 8, the dispensing panel 90 may comprise a single sidewall 92 separated from the top panel 91 by a crease line 93 to permit folding of the sidewall prior to insertion into a dispenser according to the present invention. In this manner the dispenser may comprise a dispensing panel having a sidewall disposed between the stack of tissues and a sidewall of the dispenser. By providing a single sidewall the stability of the panel may be increased and dispensing may be improved without the excessive use of material. The height (h) of the single sidewall may be varied to provide panel stability and permit compression of the dispenser. For example, the height (h) of the single sidewall 92 may be a function of the height of the stack of tissues in an uncompressed state, such as from about 70 to about 90 percent of the height of the uncompressed stack and more preferably from about 75 to about 85 percent. In this manner, a dispenser comprising a panel having a sidewall and a stack of tissues may be compressed to some degree with interference of the panel sidewall.

With reference again to FIG. 5, the dispensing panel 60 may comprise a surfboard 66, removal of which, forms a second dispensing opening having a width (w) and a length (l). The dimensions of the second opening may be varied relative to the dimensions of the first opening and/or the sheet material. In certain embodiments the first and second opening dimensions are the same shape and have the same length and width. In other embodiments the first and second openings have the same general shape but differ in at least one dimension. In still other embodiments, the first and second openings have the same general shape, but the second dispensing opening length (l) is greater than the length ($L_1$) of the first dispensing opening.

When the dispensing panel 60 is inserted between the uppermost sheet 82 in the stack 80 and the top wall 36, as illustrated in FIG. 2, the first and second dispensing openings 43, 68 generally overlap one another to an extent to form a dispensing orifice 70 through which a user may access the stack of sheets 80 disposed in the interior space 50 of the dispenser 10. While it is generally preferred that at least a portion of the first and second dispensing openings overlap one another to form the dispensing orifice, portions of the first and second dispensing opening may not overlap one another. For example, the first dispensing opening may have a width and length ($W_1$, $L_1$) that are less than the width and length (w, l) of the second dispensing opening. In other embodiments the first and second openings may differ in only one dimension, such as openings having different widths. In a particularly preferred embodiment the second opening has a width (w) that is less than the width of the first opening ($W_1$).

In still other embodiments to achieve satisfactory dispensing the dimensions of the first and second openings may be varied relative to the dimensions of the folded and stacked sheets or the top wall of the dispenser. For example, in one embodiment, the length ($L_1$) of the first dispensing opening 43 is at least about 80 percent of the length (L) of the top wall 36. In a particularly preferred embodiment the length ($L_1$) of the first dispensing opening 43 is at least from about 80 to about 95 percent, and more preferably from about 85 to about 90 percent, of the length (L) of the top wall 36. Accordingly, in certain preferred embodiments the first opening 43 is substantially rectangular and has a width ($W_1$) and a length ($L_1$), while the top wall 36 is also substantially rectangular and has a width (W) and a length (L) where L is from about 100 to about 300 mm and L is from about 200 to about 250 mm.

Figure 6:
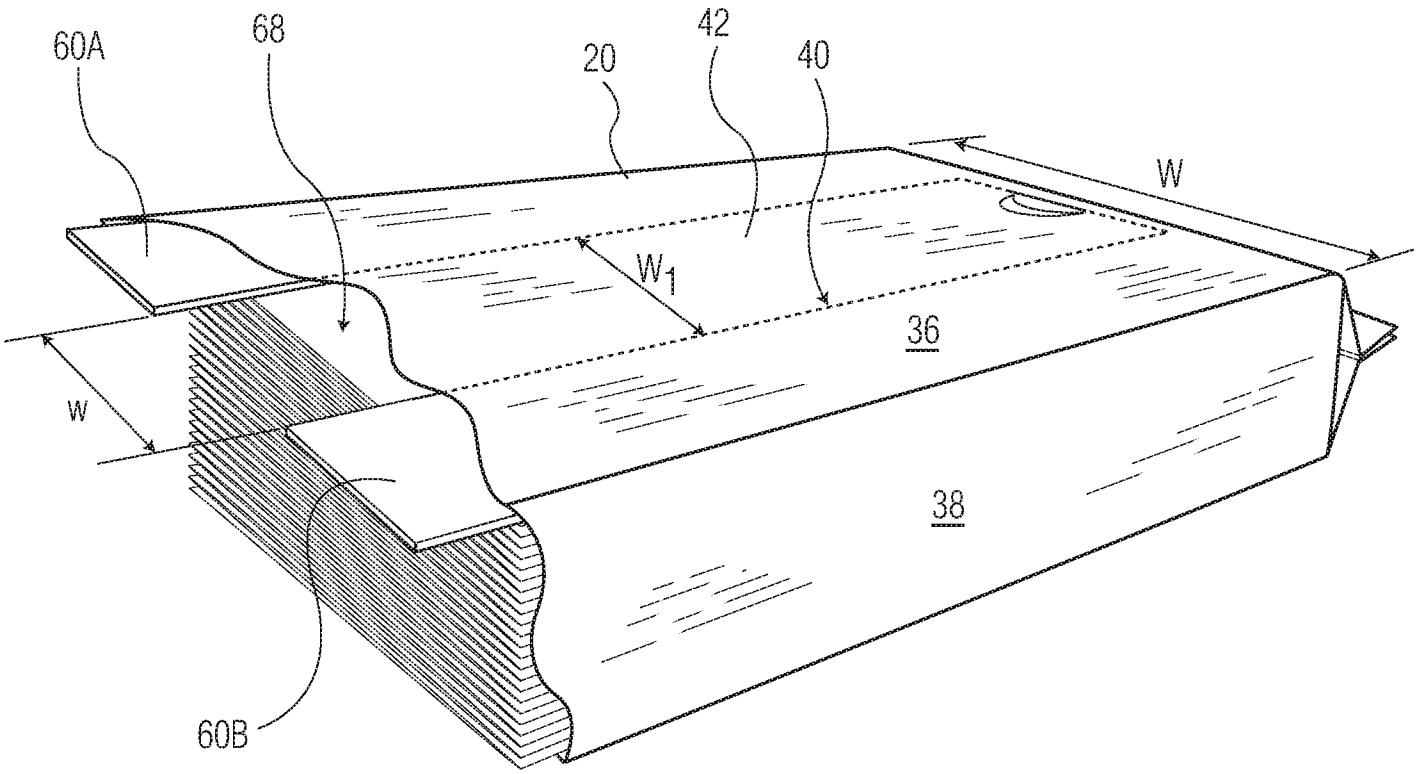
FIG. 6 is a partial cross-sectional view of a dispenser according to another embodiment of the present invention.

In still other embodiments the length (l) and width (w) of the second dispensing opening may be greater than the length ($L_1$) and width ($W_1$) of the first dispensing opening, where the length ($L_1$) of the first dispensing opening 43 is from about 80 to about 95 percent, and more preferably from about 85 to about 90 percent, of the length (L) of the top wall 36. For example, with reference to FIG. 6, the dispensing panel comprises two separate planar pieces 60A, 60B spaced apart from one another to define a second dispensing opening 68 having a width (w). In the illustrated embodiment the length of the second dispensing opening 68 is equal to the length of the two separate planar pieces 60A, 60B. The width (w) of the second dispensing opening 68 is greater than the width ($W_1$) of the first dispensing opening, which is less than the width (W) of the dispenser 10.

Just as the dimensions of the first and second dispensing openings may be varied relative to one another and the dimensions of the top wall, the dimensions may be varied relative to the length of the sheet product to be dispensed. For example, in one preferred embodiment, the length ($L_1$) of the first dispensing opening 43 is less than the length of the sheet, while the length (l) of the second dispensing opening 68 may be equal to or greater than the length of the sheet.

Figure 7:
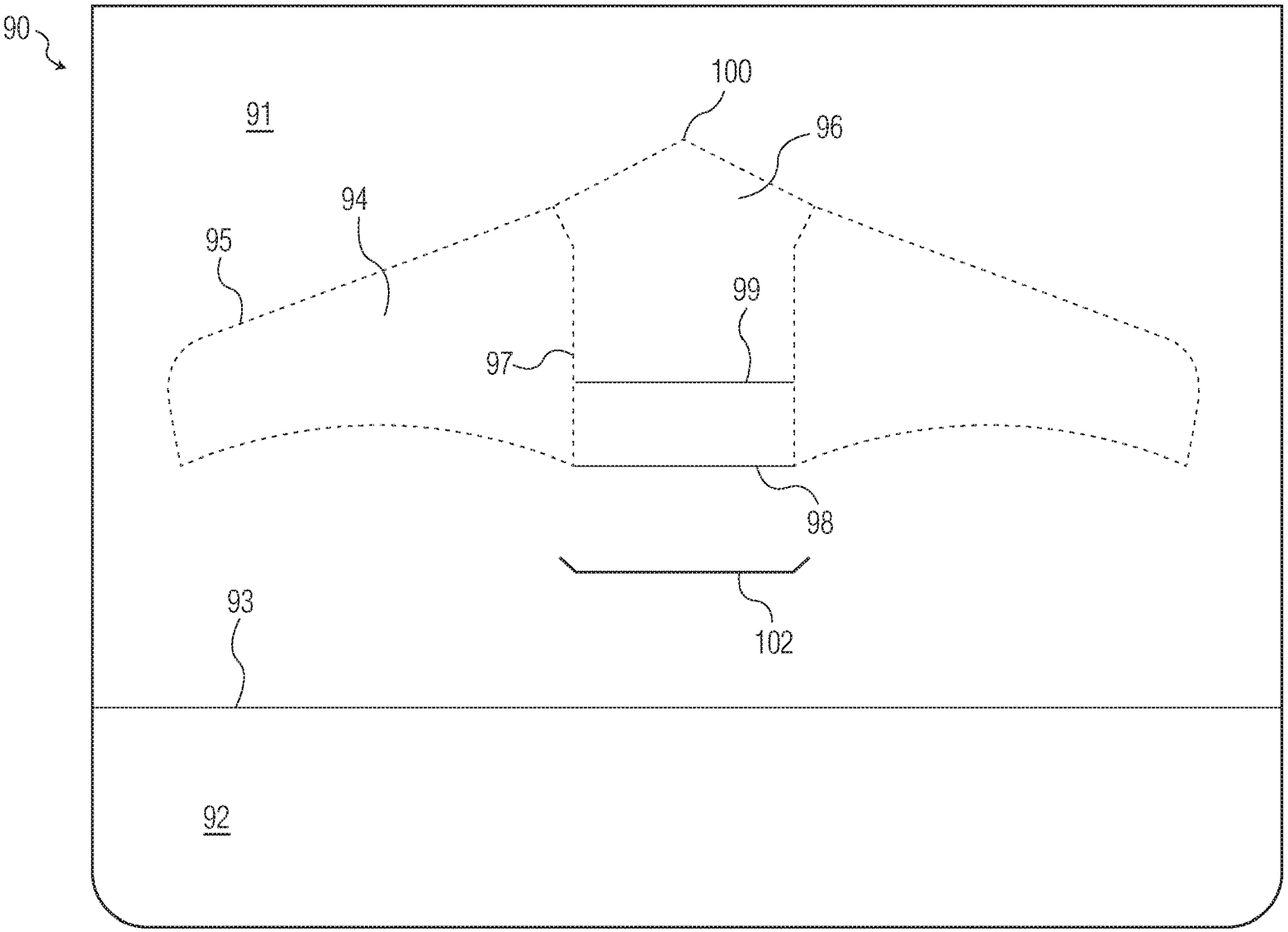
FIG. 7 is a top plan view of a dispensing panel useful in the dispenser of the present invention.

In still other embodiments, such as that illustrated in FIGS. 7 and 8, the dispensing panel 90 may comprise a top panel 91 having a surfboard 94 and breaker bar 96 covering a portion of the dispensing opening 104. When the dispenser is being opened the surfboard 94 is removed by separating along a line of perforations 95 deposed about its perimeter. Removal of the surfboard 94 leaves a breaker bar 96 which is partially separated from the top panel 91 and folded along a pair of crease lines 98, 99 to facilitate insertion of the first end 100 of the breaker bar 96 into a notch 102 disposed on the top panel 91. In this manner, as illustrated in FIG. 8, the breaker bar 96 is disposed above the top panel 91 and adjacent to the dispensing opening 104, which may have a length ($L_1$) and width ($W_1$) as described above.

In use the breaker bar may be paired with a stack of perforated tissue products to facilitate one handed dispensing of the tissues. For example, with reference to FIG. 9, the tissue product 110 may comprise a plurality of individual sheets 112*a-e* separated from one another by a first and a second line of perforations 114, 115. A plurality of notches 117*a-e* are provided between the lines of perforations 114, 115. In use, when the first tissue sheet 112*a* is pulled through the dispensing opening, the notch 117*b* may be engaged with the breaker bar to retain the sheet and facilitate rupturing of the line of perforations 114, 115.

Figure 9:
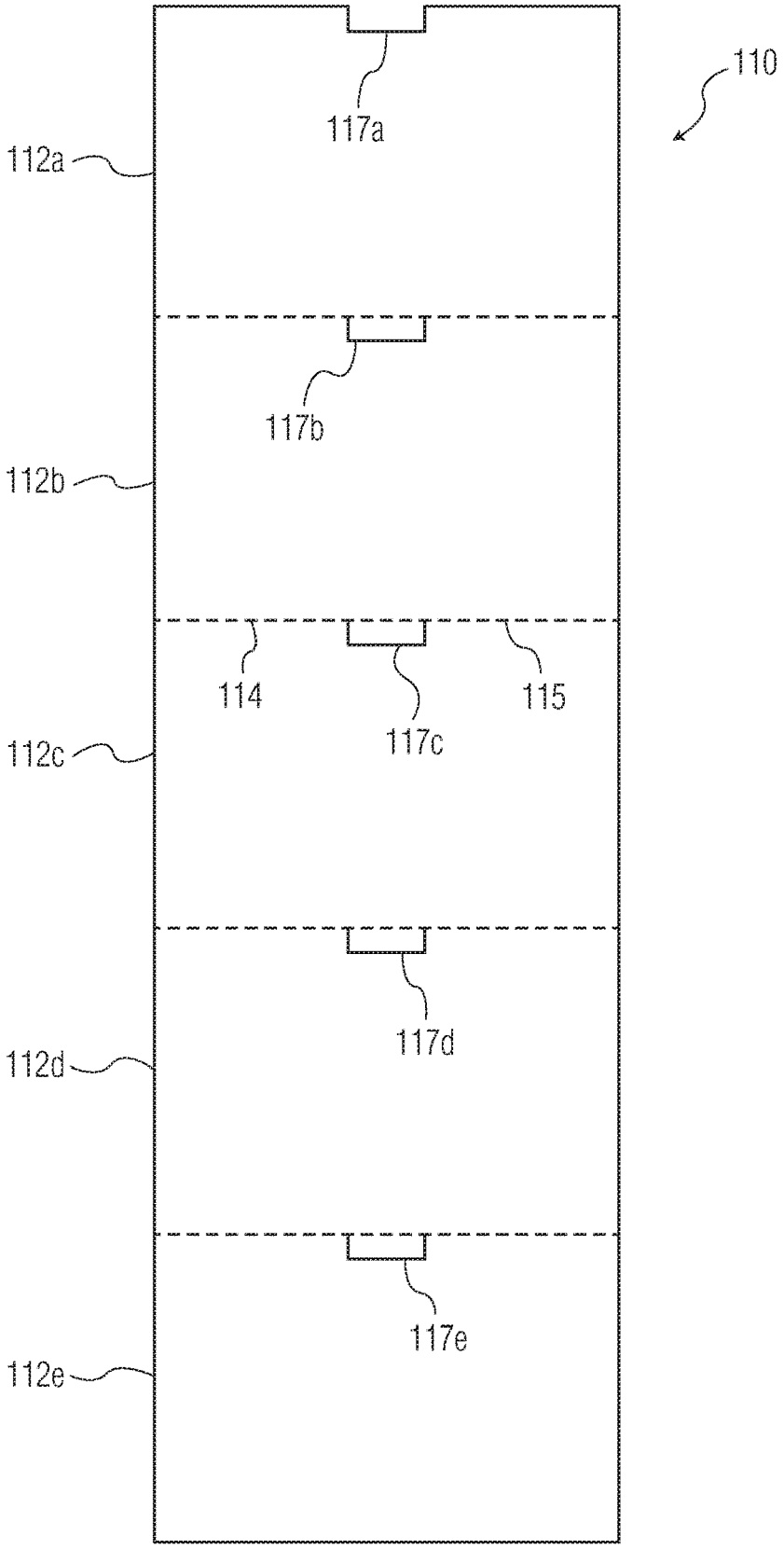
FIG. 9 is a top plan view of a sheet material comprising a plurality of perforated and notched sheets useful in the present invention.

Thus, as shown in the FIG. 9, the sheet material may comprise a continuous, elongated sheet material 110 having an elongated or longitudinal direction. The sheet material 110 may be folded into separate individual sheets 112*a-e* which are separated one from another by a line of perforations 114, 115 in a line extending from one side to the other of the sheet 112. The sheet material 110 may be folded in a zig-zag overlay pattern to form a single uniform generally rectangular shaped stack of individual sheets 112*a-e* with each sheet being separated one from the other by perforations 114, 115. Individual sheets 112*a-e* are further separated from one another by a series of notches 117*a-e*, which are generally disposed adjacent to the perforations 114, 115. In a particularly preferred embodiment the notch is spaced equal distance from either edge of the sheet. The dimensions of the notch may be varied to optimize tearing and separation of individual sheets. In a particularly preferred embodiment the dimension of the notch is optimized to cooperate with a breaker bar disposed on the dispenser panel to readily engage and retain the sheet and facilitate rupturing of the perforations by a user.

While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims and the following embodiments:

In a first embodiment the present invention provides a dispenser for storing and dispensing a stack of folded sheet material comprising: a flexible outer wrapper comprising a polymeric film having a bending stiffness from about 2.0 to about 20.0 Taber Stiffness Units, the outer wrapper having first and second sealed ends, a top wall and a bottom wall and a cavity, the top wall having a length and a width and a plurality of perforations defining a first dispensing opening having a length and a width; a stack of folded sheet material disposed within the cavity, the stack having a length and a width and an uppermost folded sheet; a dispensing panel having a bending stiffness from about 100 to about 400 Taber Stiffness Units disposed between the uppermost folded sheet and the top wall of the flexible outer wrapper, the dispensing panel having a length and a width and a second dispensing opening having a length and a width; wherein the length of the first dispensing opening is at least about 80 percent of the length of the top wall.

In a second embodiment the present invention provides the invention of the first embodiment wherein the length of the first dispensing opening is from about 80 to about 95 percent of the length of the top wall and the length of the second dispensing opening is greater than the length of the first dispensing opening.

In a third embodiment the present invention provides the invention of the first or the second embodiments wherein the first and second dispensing openings have a substantially identical shape and the length of the first dispensing opening is less than the length of the second dispensing opening.

In a fourth embodiment the present invention provides the invention of any one of the first through third embodiments further comprising a removable surfboard covering at least a portion of the second dispensing opening, the removable surfboard may optionally be attached to the top wall.

In a fifth embodiment the present invention provides the invention of any one of the first through fourth embodiments wherein the folded stack of sheets has a length from about 175 to about 300 mm, the top wall has a length from about 80 to about 100 percent of the length of the sheets and the first and second dispensing openings have lengths from about 80 to about 95 percent of the length of the top wall.

In a sixth embodiment the present invention provides the invention of any one of the first through fifth embodiments wherein the flexible outer wrapper comprises a polymeric sheet material folded and sealed to provide a pair of transverse end seals and a longitudinal fin seal.

In a seventh embodiment the present invention provides the invention of any one of the first through sixth embodiments wherein the flexible outer wrapper has a bending stiffness from about 4.0 to about 10.0 Taber Stiffness Units.

In an eighth embodiment the present invention provides the invention of any one of the first through seventh embodiments wherein the dispensing panel comprises a planar paperboard sheet having a length greater than the length of the stack of tissues.

In a ninth embodiment the present invention provides a dispenser for storing and dispensing a stack of sheet material comprising: a flexible outer wrapper defining a cavity, the outer wrapper having first and second sealed ends, a top wall and a bottom wall, the top wall having a length and a width and a plurality of perforations defining a first dispensing opening having a length and a width; a stack of sheet material disposed within the cavity, the stack having a length and a width and an uppermost folded sheet; a dispensing panel having a bending stiffness from about 100 to about 400 Taber Stiffness Units disposed between the uppermost folded sheet and the top wall of the flexible outer wrapper, the dispensing panel having a length and a width and a second dispensing opening thereon, the second dispensing opening having a length and a width and a breaker bar attached to the dispensing panel; wherein the length of the first dispensing opening is at least about 80 percent of the length of the top wall.

In a tenth embodiment the present invention provides the invention of the ninth embodiment wherein the breaker bar has a first and a second end, the first end being releasably attached to the top panel and the second end foldably attached to the top panel, and the top panel further comprises a notch, wherein the first end of the breaker bar may be inserted into the notch.

In an eleventh embodiment the present invention provides the invention of the ninth or tenth embodiments wherein the dispensing panel further comprises a sidewall having a height (h), where the stack of sheet material has an uncompressed height, and the height (h) of the sidewall may be from about 70 to about 90 percent and more preferably from about 75 to about 85 percent of the height of the uncompressed stack of sheet material.

In a twelfth embodiment the present invention provides the invention of any one of the ninth through eleventh embodiments wherein the stack of sheet material comprises a plurality of individual sheets separated from one another by a line of perforations and each individual sheet comprises a notch.

In a thirteenth embodiment the present invention provides a dispensing panel comprising a substantially planar sheet having a bending stiffness from about 100 to about 400 Taber Stiffness Units, the dispensing panel having a dispensing opening having a length and a width, and a breaker bar attached to the panel and movable from a first position covering a portion of the opening to a second position above the plane of the dispensing panel.

In a fourteenth embodiment the present invention provides the invention of the thirteenth embodiment further comprising a notch disposed on the dispensing, optionally the notch may be shaped to receive a first free end of the breaker bar.

In a fifteenth embodiment the present invention provides the invention of the thirteenth or fourteenth embodiments wherein the breaker bar is integrally formed with the dispensing panel and comprises a first crease line for moving the bar from a first position covering a portion of the opening to a second position above the plane of the dispensing panel.

In a sixteenth embodiment the present invention provides a plurality of individually sheets separated from one another by a line of perforations, wherein each sheet comprises a notch.

In a seventeenth embodiment the present invention provides a dispenser comprising a flexible outer wrapper defining a cavity, a dispensing panel comprising a substantially planar sheet having a bending stiffness from about 100 to about 400 Taber Stiffness Units, the dispensing panel having a dispensing opening having a length and a width, a breaker bar attached to the panel and movable from a first position covering a portion of the opening to a second position above the plane of the dispensing panel and a plurality of individual sheets separated from one another by a line of perforations, wherein each sheet comprises a notch disposed with the cavity.

What is claimed is:

1. A dispenser comprising a polymeric film having a bending stiffness from about 4.0 to about 10.0 Taber Stiffness Units folded to define a cavity and a first sealed end, a second sealed end, a top wall and a bottom wall, the top wall having a length and a width and a plurality of perforations defining a first dispensing opening having a length and a width; a stack of sheet material disposed within the cavity, the stack having a length and a width and an uppermost folded sheet; a planar dispensing panel having a bending stiffness from about 100 to about 400 Taber Stiffness Units disposed between the uppermost folded sheet and the top wall of the dispenser, the dispensing panel having a length and a width and a second dispensing opening having a length and a width; wherein the length of the first dispensing opening is at least about 80 percent of the length of the top wall.

2. The dispenser of claim 1 wherein the length of the first dispensing opening is from about 80 to about 95 percent of the length of the top wall and the length of the second dispensing opening is greater than the length of the first dispensing opening.

3. The dispenser of claim 1 wherein the first and second dispensing openings have a substantially identical shape and the length.

4. The dispenser of claim 1 further comprising a removable surfboard covering at least a portion of the second dispensing opening.

5. The dispenser of claim 1 wherein the folded stack of sheets has a length from about 175 to about 300 mm, the top wall has a length from about 80 to about 100 percent of the length of the sheets and the first and second dispensing openings have lengths from about 80 to about 95 percent of the length of the top wall.

6. The dispenser of claim 1 wherein the polymeric sheet material is folded and sealed to provide a pair of transverse end seals and a longitudinal fin seal.

7. The dispenser of claim 1 wherein the planar dispensing panel comprises a paperboard sheet having a length greater than the length of the stack of tissues.

8. The dispenser of claim 1 wherein the stack of sheet material comprises a plurality of individual sheets separated from one another by a line of perforations.

9. The dispenser of claim 8 wherein the individual sheets comprise a notch.

10. A dispenser for storing and dispensing a stack of dry tissue products comprising:

a. a polymeric film having a bending stiffness from about 4.0 to about 10.0 Taber Stiffness Units and folded to define a cavity, a first sealed end, a second sealed end, a top wall and a bottom wall, the top wall having a first dispensing opening disposed thereon, the first dispensing opening having a length and a width;

b. a stack of folded dry tissue products disposed within the cavity, the stack having a length and a width and an uppermost tissue product; and c. a planar paperboard sheet disposed between the uppermost tissue product and the top wall of the folded polymeric film, the paperboard sheet having a length and a width and a plurality of perforations defining a removable surfboard disposed thereon, the removable surfboard forming a second dispensing opening having a length and a width; wherein the length of the second dispensing opening is from about 80 to about 95 percent of the length of the planar paperboard sheet.

11. The dispenser of claim 10 wherein the stack of folded dry tissue products has a length from about 175 to about 300 mm, the top wall has a length from about 80 to about 100 percent of the length of the sheets and the first and second dispensing openings have lengths from about 80 to about 95 percent of the length of the top wall.

12. The dispenser of claim 10 wherein the length of the first dispensing opening is from about 80 to about 95 percent of the length of the top wall and the length of the second dispensing opening is greater than the length of the first dispensing opening.

13. The dispenser of claim 10 wherein the first and second dispensing openings have a substantially identical shape and length.

14. A dispenser for storing and dispensing a stack of sheet material comprising: a polymeric film having a bending stiffness from about 4.0 to about 10.0 Taber Stiffness Units and folded to define a cavity, a first sealed end, a second sealed end, a top wall and a bottom wall, the top wall having a length and a width and a plurality of perforations defining a first dispensing opening having a length and a width; a stack of sheet material disposed within the cavity, the stack of sheet material having a length and a width and an uppermost sheet; a planar dispensing panel having a bending stiffness from about 100 to about 400 Taber Stiffness Units disposed between the uppermost sheet and the top wall of the folded polymeric film, the dispensing panel having a length and a width and a second dispensing opening disposed thereon, the second dispensing opening having a length and a width and a breaker bar attached to the dispensing panel; wherein the length of the first dispensing opening is at least about 80 percent of the length of the top wall.

15. The dispenser of claim 14 wherein the breaker bar has a first and a second end, the first end being releasably attached to the top panel and the second end foldably attached to the top panel, and the top panel further comprises a notch, wherein the first end of the breaker bar may be inserted in the notch.

16. The dispenser of claim 14 wherein the dispensing panel further comprises a sidewall having a height (h).

17. The dispenser of claim 16 wherein the stack of sheet material has an uncompressed height and the height (h) of the sidewall is from about 70 to about 90 percent of the height of the uncompressed stack of sheet material.

18. The dispenser of claim 14 wherein the stack of sheet material comprises a plurality of individual sheets separated from one another by a line of perforations and each individual sheet comprises a notch.

* * * * *